US006140289A

United States Patent [19]

McCandlish et al.

[11] Patent Number: 6,140,289

[45] Date of Patent: Oct. 31, 2000

[54] ANTIMICROBIAL CLEANING COMPOSITION CONTAINING A CATIONIC SURFACTANT

[75] Inventors: Elizabeth McCandlish, Highland Park, N.J.; Brian Frank, Arlington Heights, Ill.

[73] Assignee: Colgate-Palmolive Company, New York, N.Y.

[21] Appl. No.: 09/490,546

[22] Filed: Jan. 24, 2000

[51] Int. Cl.[7] ..... C11D 1/62; C11D 1/72; C11D 3/22; C11D 1/75

[52] U.S. Cl. ..... 510/235; 510/237; 510/356; 510/382; 510/384; 510/391; 510/470; 510/490; 510/503; 510/504

[58] Field of Search ..... 510/235, 237, 510/356, 382, 384, 391, 470, 490, 503, 504

[56] References Cited

U.S. PATENT DOCUMENTS

| | | | |
|---|---|---|---|
| 4,174,304 | 11/1979 | Flanagan | 252/524 |
| 4,446,042 | 5/1984 | Leslie | 252/102 |
| 5,454,984 | 10/1995 | Graubart et al. | 252/547 |
| 5,728,667 | 3/1998 | Richter | 510/235 |
| 5,798,329 | 8/1998 | Taylor et al. | 510/384 |

*Primary Examiner*—Yogendra Gupta
*Assistant Examiner*—Charles Boyer
*Attorney, Agent, or Firm*—Richard E. Nanfeldt

[57] ABSTRACT

An improvement is described in a cleaning compositions which are especially effective in disinfecting the surface being cleaned and in the removal of oily and greasy soil without leaving streaks which contains a mixture of at least one nonionic surfactant, a cationic surfactant and an amine oxide surfactant, and water.

6 Claims, No Drawings

ANTIMICROBIAL CLEANING COMPOSITION CONTAINING A CATIONIC SURFACTANT

FIELD OF THE INVENTION

This invention relates to a composition to be used for manual dishwashing and that is capable of killing germs on hard surfaces to a much greater extent than typical manual dishwashing products in the market.

BACKGROUND OF THE INVENTION

Typical manual dishwashing compositions are based on anionic surfactants. These compositions foam generously and are effective at cleaning kitchen soils, especially greasy soil. However, these products cannot be considered disinfectants, because they do not pass stringent disinfectancy tests such as the AOAC use-dilution test.

Disinfectant compositions containing cationic surfactants and nonionic surfactants are well known, but they do not have the foam needed for a manual dishwashing detergent. These products also do not remove triglyceride soils effectively. Often, after the compositions are rinsed, the direct surfaces exhibits streaks and spots.

Combinations of anionic surfactants and cationic, antimicrobial surfactants are possible but this combination reduces the foam, creates instability problems and deactivates the disinfectant behavior of the cationic surfactant.

It has now been found that a unique formula comprising cationic, nonionic, and zwitterionic surfactants can overcome these deficiencies and provide good foam, good grease and soil removal, as well as providing good rinsing together with a high level of disinfectancy.

SUMMARY OF THE INVENTION

The present invention relates to compositions comprising approximately by weight:

from 0.1 to 10% of at least one disinfecting agent such as cationic surfactant;

from 10% to 20% of at least one nonionic surfactant;

from 0 to 2%, more preferably 0.1% to 1.5% of an ethoxylated alkanolamide;

from 0 to 5% of a zwitterionic surfactant;

15% to 24% of an amine oxide surfactant;

0 to 5% of an alkyl polyglucoside surfactant; and the balance being water.

DETAILED DESCRIPTION OF THE INVENTION

The present invention relates to a stable cleaning composition comprising approximately by weight:

0.1% to 10% of at least one disinfecting agent such as a cationic surfactant,

10% to 20% of at least one nonionic surfactant;

0 to 2%, more preferably 0.1% to 1.5% of an ethoxylated alkanol amide;

0 to 5% of a zwitterionic surfactant,

15% to 24% of an amine oxide surfactant;

0 to 5% of an alkyl polyglucoside surfactant; and the balance being water, wherein the composition does not contain inorganic or organic builder salts, anionic surfactants, biguanide compounds, amino acid germicides, glucamide surfactant, mono- or di-alkanol amides which are not ethoxylated, inorganic polymeric thickeners, fatty acid monoglycerides, organic acids or 1 -(4-chlorophenoxyl)-1-imidazol-1-yl-3,3dimethyl butan-2-on.

The cationic surfactant constitutes about 0.1 to 10% by weight, preferably 1% to 8% by weight of the composition. It is depicted by the formula:

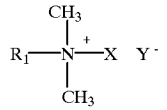

wherein $R_1$ is a $C_8$–$C_{18}$ alkyl group and X is selected from the group $C_8$–$C_{12}$ and a benzyl group or ethyl benzyl group. $Y^-$ is a halide. Especially preferred cationic surfactants are BTC 835 and BTC 888, manufactured by the Stepan Company. BTC 835 is a $C_{12}$–$C_{16}$ alkyl dimethyl benzyl ammonium chloride. BTC 888 is a mixture of approximately 32 wt. % of alkyl dimethyl benzyl ammonium chloride (alkyl= $C_{14}$–$C_{16}$), approximately 24 wt. % octyl decyl dimethyl ammonium chloride, approximately 12 wt. % dioctyl dimethyl ammonium chloride and about 12 wt. % didecyl ammonium chloride and the balance being water. Mixtures of the above cationic surfactants are also useful.

The water soluble nonionic surfactants which are utilized in this invention at a concentration of 10 to 20 wt. %, more preferably 12 to 18 wt. % are commercially well known and include the primary aliphatic alcohol ethoxylates, secondary aliphatic alcohol ethoxylates, alkylphenol ethoxylates and ethylene-oxide-propylene oxide condensates on primary alkanols, such as Plurafacs™ (BASF), and condensates of ethylene oxide with sorbitan fatty acid esters, such as the Tweens™ (ICI). The nonionic synthetic organic surfactants generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol™ ethoxylates (Shell Co.), which are higher aliphatic, primary alcohols containing about 9–15 carbon atoms, such as $C_9$–$C_{11}$ alkanol condensed with 2.5 to 10 moles of ethylene oxide (Neodol™ 91-2.5 or -5 or -6 or -8), $C_{12-13}$ alkanol condensed with 6.5 moles ethylene oxide (Neodol™ 23-6.5), $C_{12-15}$ alkanol condensed with 12 moles ethylene oxide (Neodol™ 25-12), $C_{14-15}$ alkanol condensed with 13 moles ethylene oxide (Neodol™ 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol™ 15-S-9) or 12 EO (Tergitol™ 15-S-12), marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal™ CO-630 (nonyl phenol ethoxylate) marketed by GAF Corporation.

Also among the satisfactory nonionic surfactants are the water-soluble condensation products of a $C_8$–$C_{20}$ alkanol with a mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such surfactants are commercially available from BASF-Wyandotte. A particularly preferred detergent is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween™ trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name "Pluronics™". The compounds are block copolymers of ethylene oxide and propylene oxide. The molecular weight of the hydrophobic (polypropylene oxide) portion of the molecule is of the order of 950 to 7000 and preferably 1000 to 6000. The molecular weight of the block polymers varies from 1,000 to 20,000 and the polyethylene oxide content may comprise 20% to 90% by weight. Preferably, these surfactants will be in liquid form and satisfactory surfactants are available as grades F108 and P103.

Other suitable nonionic detergents are marketed under the tradename "Tetronics". Tetronic™ and Tetronic™ R surfactants are tetra functional block copolymers made by adding ethylene oxide and propylene oxide to ethylene diamine. The Tetronic surfactants having the PO groups directly attached to the ethylene diamine are preferred. The polymers with 30% EO to 80% EO are preferred. Especially preferred are commercial products #307 and #704.

The instant compositions can optionally contain about 0 to about 2 wt. %, more preferably about 0.1 to about 1.5 wt. % of an ethoxylated $C_{12}$–$C_{14}$ alkyl monoalkanol amide containing 1 to 6 ethoxylated groups such as PEG-6 Lauramide having the structure $C_{12}H_{23}CONH(CH_2CH_2O)_6H$.

The instant composition can also optionally contain 0 to 5%, more preferably 0.1 to 4%, by weight of an amphoteric zwitterionic surfactant. It can be a water-soluble betaine having the general formula:

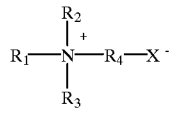

wherein $X^-$ is selected from the group consisting of $CO_2$— and $SO_3$— and $R_1$ is an alkyl group having 10 to about 20 carbon atoms, preferably 12 to 16 carbon atoms, or an amido radical:

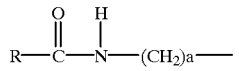

wherein R is an alkyl group having about 9 to 19 carbon atoms and a is the integer 1 to 4; $R_2$ and $R_3$ are each alkyl groups having 1 to 3 carbon atoms and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine, myristyl dimethyl betaine, plamityl dimethyl betaine, lauryl dimethyl betaine, cetyl dimethyl betaine, stearyl dimethyl betaine, etc. The amido betaines similarly include cocoamidoethylbetaine, cocoamidopropyl betaine and the like. Preferred betaines are coco ($C_8$–$C_{18}$) amidopropyl dimethyl betaine or cocodimethyl betaine. Two preferred betaine surfactants are Amphosol™ CG from Stepan or Mackam™ CB25 from McIntyre.

The amine oxides are used at a concentration of 15 to 24 wt. %, more preferably 16 wt. % to 22 wt. % in forming the liquid cleaning compositions are depicted by the formula:

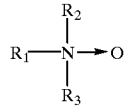

wherein $R_1$ is a $C_{10}$–$C_{18}$ linear or branched chain alkyl group, $R_2$ is a $C_1$–$C_{16}$ linear alkyl group and $R_3$ is a $C_1$–$C_{16}$ linear alkyl group, or the amido radical:

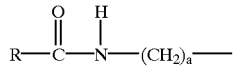

wherein R is an alkyl group having about 9 to 19 carbon atoms and a is the integer 1 to 4. Preferably R2 and R3 are each alkyl groups having 1 to 3 carbons and most preferably 1 carbon.

The instant compositions can contain about 0 to about 5 wt. %, more preferably 0.5 to 5 wt. % of an alkyl polysaccharide surfactant. The alkyl polysaccharides surfactants have a hydrophobic group containing from about 8 to about 20 carbon atoms, preferably from about 10 to about 16 carbon atoms, most preferably from about 12 to about 14 carbon atoms.

The polysaccharide hydrophilic group contains from about 1.2 to about 10, preferably from about 1.2 to about 4, most preferably from about 1.4 to about 2.7 saccharide units (e.g., galactoside, glucoside, fructoside, glucosyl, fructosyl, and/or galactosyl units).

The effect of small amounts of APG is to increase the score on the foam mileage test without harming the other properties. Large amounts of APG decrease the foam mileage and/or the initial foam.

Mixtures of saccharide moieties may be used in the alkyl polysaccharide surfactants. In any physical sample of alkyl polysaccharide surfactants, each molecule will have a particular number of saccharide units. A physical sample can be characterized by the average value of x, and this average value can be non-integral. In this specification, the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position is preferred. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 16, preferably from about 12 to about 14 carbon atoms; n is 2 or 3 preferably 2, r is from 0 to 10, preferably 0; and x is from 1.2 to 8, preferably from 1.4 to 4, most preferably from 1.4 to 2.7. Depending on the synthesis used, alkyl glucoside sometimes contain short chain alcohols. The short chain alkylglucoside content of the final alkyl polyglucoside material should be less than 50%, preferably less than 10%, more preferably less than about 5%, most preferably 0% of the alkyl polyglucoside.

The free fatty alcohol content in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG™ 625 glycoside manufactured by the Henkel Corporation of Ambler, PA. APG™25 is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.5–1.6.

The final essential ingredient in the invention is water. The proportion of water in the compositions generally is in the range of 20% to 97%, preferably 70% to 97% by weight.

In addition to the above-described essential ingredients, the compositions of this invention may often, and preferably do, contain one or more additional ingredients which serve to improve overall product performance.

The liquid cleaning composition of this invention may also contain other components either to provide additional effect or to make the product more attractive to the consumer. The following are mentioned by way of example: Colors or dyes in amounts up to 0.5% by weight, 2,6-di-tert.butyl-p-cresol, etc., in amounts up to 2% by weight; and pH adjusting agents, such as sulfuric acid or sodium hydroxide, as needed. If opaque compositions are desired, up to 4% by weight of an opacifier may be added. If more or less viscous compositions are desired, viscosity modifiers up to 4% by weight may be added.

The viscosity of the light duty liquid composition desirably will be at least 50 centipoises (cps) at room temperature, but may be up to 1,000 centipoises as measured with a Brookfield Viscometer using small sample adaptor and a #21 spindle rotating at 20 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is substantially neutral to skin, e.g., 4.5 to 8 and preferably 5.0 to 7.0. The pH of the composition can be adjusted by the addition of acid or alkali to the composition.

When used at home, the invention, has an additional advantage over conventional dishwashing compositions because they rinse more easily and impart a shine that is not marred by deposits or spots.

The instant compositions have a minimum foam volume of 340 mis after 40 rotations at 250C as measured by the foam volume test using 0.033 wt. % of the composition in 150 ppm of water. The foam test is an inverted cylinder test in which 100 ml. of a 0.033 wt. % LDL formula in water of 150 ppm hardness is placed in a stoppered graduated cylinder (500 ml) and inverted 40 cycles at a rate of 30 cycles/minute. After 40 inversions, the foam volume which has been generated is measured in milliliters inside the graduated cylinder. This value includes the 100 ml of LDL solution inside the cylinder.

The instant formulas explicitly exclude alkali metal silicates and alkali metal builders such as alkali metal polyphosphates, alkali metal carbonates, and alkali metal phosphonates. These materials, if used in the instant composition, would cause the composition to have a high pH as well as leaving residue on the surface being cleaned.

The following examples illustrate liquid cleaning compositions of the described invention. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A | B | C | D | Commercial Detergent #1 | Commercial Detergent #2 |
|---|---|---|---|---|---|---|
| Coco dimethyl betaine (Mackam ™ CB-35) | — | 4.4 | 1.6 | | | |
| PEG-6 Lauramide Amidox ™ L5 | — | .8 | — | — | | |
| BCT888 | 5.4 | 5.3 | 5.3 | 6.1 | | |
| Cocoamido propyl dimethyl amine oxide | 18.4 | 18.8 | 18.8 | 187 | | |
| APG ™625 | 1.7 | 1.2 | .4 | — | | |
| Neodol 91-6 | 14.4 | 9.6 | 14.0 | 15.2 | | |
| Water | Bal. | Bal. | Bal. | | | |
| UDT positive tubes of 30 tubes Ten min., *S. Aureus* | 1 | 2 | 0 | 0 | 30 | 30 |
| Cup % tallow removal | 13 | 19 | 13 | 11 | 2 | 12 |

-continued

| | A | B | C | D | Commercial Detergent #1 | Commercial Detergent #2 |
|---|---|---|---|---|---|---|
| Shake Foam initial | 345 | 343 | 353 | 352 | 420 | 370 |
| Shell mileage test Foam Performance Ratio | 118 | 116 | 115 | 82 | 100 | 108 |

What is claimed is:

1. A cleaning composition comprising approximately by weight:

(a) 0.1% to 10% of at least one cationic surfactant;

(b) 12% to 18% of an ethoxylated nonionic surfactant;

(c) 15% to 24% of an amine oxide surfactant;

(d) 0.05% to 5% of an alkyl polyglucoside surfactant; and (e) the balance being water, wherein said cleaning composition does not contain inorganic or organic builder salts, anionic surfactants or mono- or di-alkanol amides which are not ethoxylated.

2. The composition of claim 2 wherein said cationic surfactant is a $C_{14}$–$C_{15}$ alkyl dimethyl benzyl ammonium chloride.

3. The composition according to claim 1, whereas said cationic surfactant is a $C_{8-C10}$ dialkyl dimethyl ammonium chlorides.

4. The composition of claims 1 or 2, further including a zwitterionic surfactant.

5. The composition of claims 1 or 2, further including a zwitterionic surfactant and an ethoxylated $C_{12}$–$C_{14}$ alkanolamide.

6. The composition of claim 1 further including 0.1 wt. % to 1.5 wt. % of an ethoxylated $C_{12}$–$C_{14}$ alkyl mono alkanol amide.

* * * * *